US008959705B2

(12) United States Patent
Juergens et al.

(10) Patent No.: US 8,959,705 B2
(45) Date of Patent: Feb. 24, 2015

(54) ROBOT FOR CLEANING SMOOTH SURFACES

(75) Inventors: Ralf Juergens, Laudenbach (DE); Marc Hunger, Viernheim (DE)

(73) Assignee: Carl Freudenberg KG, Weinheim (DE)

( * ) Notice: Subject to any disclaimer, the term of this patent is extended or adjusted under 35 U.S.C. 154(b) by 0 days.

(21) Appl. No.: 13/635,569

(22) PCT Filed: Feb. 4, 2011

(86) PCT No.: PCT/EP2011/000516
§ 371 (c)(1),
(2), (4) Date: Sep. 17, 2012

(87) PCT Pub. No.: WO2011/113509
PCT Pub. Date: Sep. 22, 2011

(65) Prior Publication Data

US 2013/0007971 A1 Jan. 10, 2013

(30) Foreign Application Priority Data

Mar. 18, 2010 (DE) ..... 10 2010 011 845

(51) Int. Cl.
*A47L 11/29* (2006.01)
*A47L 1/02* (2006.01)
*A47L 11/40* (2006.01)

(52) U.S. Cl.
CPC ..... *A47L 1/02* (2013.01); *A47L 11/4044* (2013.01); *A47L 11/4088* (2013.01); *A47L 2201/00* (2013.01)
USPC ..... 15/319; 15/320; 15/340.1; 134/21

(58) Field of Classification Search
CPC ..... A47L 11/29; A47L 2201/00
USPC ..... 15/320, 319, 322, 340.1; 134/21
IPC ..... A47L 11/29
See application file for complete search history.

(56) References Cited

U.S. PATENT DOCUMENTS

| | | | | |
|---|---|---|---|---|
| 5,655,247 | A | 8/1997 | Allen et al. | |
| 6,021,545 | A | 2/2000 | Delgado et al. | |
| 6,811,338 | B1 | 11/2004 | Manske, Jr. et al. | |
| 7,761,954 | B2 * | 7/2010 | Ziegler et al. | 15/320 |
| 8,495,781 | B2 * | 7/2013 | Dingert | 15/50.3 |

(Continued)

FOREIGN PATENT DOCUMENTS

| | | | |
|---|---|---|---|
| CN | 1074108 | A | 7/1993 |
| CN | 1181694 | A | 5/1998 |

(Continued)

OTHER PUBLICATIONS

European Patent Office, International Search Report in International Patent Application No. PCT/EP2011/000516 (May 19, 2011).

*Primary Examiner* — David Redding
(74) *Attorney, Agent, or Firm* — Leydig, Voit & Mayer, Ltd.

(57) ABSTRACT

An automatic robot for cleaning smooth surfaces includes a base having a traveling device, a water feed line and a water drain line. The traveling device is configured to automatically move the base on a smooth surface to be cleaned. The water feed line is configured to apply water to the smooth surface using a capillary effect. The water drain line is configured to drain dirty water from the smooth surface.

10 Claims, 2 Drawing Sheets

(56) References Cited

U.S. PATENT DOCUMENTS

| | | | |
|---|---|---|---|
| 2003/0066160 | A1 | 4/2003 | Meller |
| 2009/0133056 | A1 | 5/2009 | Yun |

FOREIGN PATENT DOCUMENTS

| | | | |
|---|---|---|---|
| CN | 1378433 | A | 11/2002 |
| CN | 1452673 | A | 10/2003 |
| DE | 19611371 | A1 | 10/1996 |
| DE | 19947459 | A1 | 7/2000 |
| DE | 102006033668 | A1 | 1/2008 |
| DE | 102007041068 | A1 | 3/2009 |
| JP | 2009219831 | A | 10/2009 |
| KR | 1020070104472 | A | 4/2009 |
| WO | WO 9632876 | A1 | 10/1996 |
| WO | WO 0192622 | A1 | 12/2001 |

* cited by examiner

ROBOT FOR CLEANING SMOOTH SURFACES

CROSS-REFERENCE TO PRIOR APPLICATIONS

This application is a U.S. National Phase application under 35 U.S.C. §371 of International Application No. PCT/EP2011/000516, filed on Feb. 4, 2011, and claims benefit to German Patent Application No. DE 10 2010 011 845.1, filed on Mar. 18, 2010. The International Application was published in German on Sep. 22, 2011 as WO 2011/113509 under PCT Article 21(2).

FIELD

The invention relates to an automatic robot for cleaning smooth surfaces, comprising a base, the base having a traveling device by means of which the base can be automatically moved on a smooth surface that is to be cleaned, and the base having a water feed line to apply water to the smooth surface and a water drain line to drain dirty water away from the smooth surface.

The invention also relates to a method for cleaning smooth surfaces, in which an automatic robot is moved on a smooth surface that is to be cleaned, whereby the robot applies water onto and removes water from the smooth surface that is to be cleaned.

BACKGROUND

Robots of the above-mentioned type are already known from the state of the art. With these robots, it is a drawback that they have to carry quite a large volume of water for cleaning purposes. This is especially problematic when they are moving on surfaces that are arranged orthogonally with respect to the ground such as window panes. This is associated with a high expenditure of energy since a large amount of water has to be transported. It is also a drawback that more energy has to be expended in order to hold the robot against the window panes, especially by means of negative pressure.

In some cases, robots of the state of the art need an external water supply. Here, the water has to be pumped through a hose connection from a reservoir. Once again, this calls for extensive equipment.

Moreover, it is disadvantageous that the robots apply a relatively large amount of water and thus cleansing agents to the smooth surfaces that are to be cleaned in order to perform a thorough cleaning This constitutes a burden on the environment.

Excess water can especially result in streaks or smears on window panes. Finally, it is a drawback that excess water can drip onto the window sills.

SUMMARY

In an embodiment, the present invention provides an automatic robot for cleaning smooth surfaces. The robot includes a base having a traveling device, a water feed line and a water drain line. The traveling device is configured to automatically move the base on a smooth surface to be cleaned. The water feed line is configured to apply water to the smooth surface using a capillary effect. The water drain line is configured to drain dirty water from the smooth surface.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
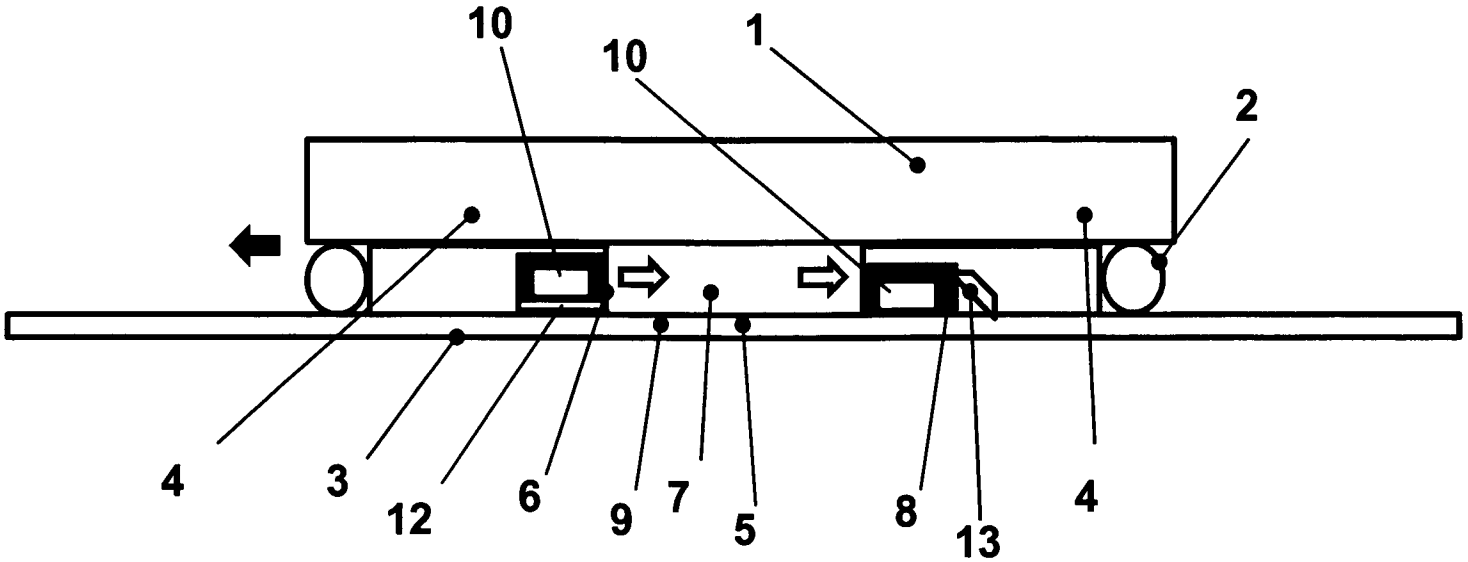
FIG. 1 is a sectional view of a robot for cleaning window panes in which the water feed line is fitted with a bundle of fibers, tubes and/or filaments that meters water onto the window pane by means of a capillary effect.

In an embodiment, the invention provides a robot that is configured and refined in such a way that an energy-saving and environmentally friendly cleaning method can be carried out while achieving a good cleaning performance.

According to an embodiment of the invention, the robot includes a water feed line that applies the water to the smooth surface by means of a capillary effect.

According to an embodiment of the invention, it has been recognized that the use of such a robot prevents streaks, smears and dripping water. Moreover, it has been recognized that such a robot can be dimensioned so as to have a relatively light weight. The batteries used for the robot can also be dimensioned so as to be small. This can cut costs. The fact that the robot carries relatively small amounts of water yields an energy-saving and environmentally friendly cleaning method.

Negative pressure could be used in the water drain line in order to remove the water from the smooth surface that is to be cleaned. In this manner, the water can be suctioned off by means of a source of negative pressure.

Before this backdrop, the water drain line could use a capillary effect to remove the water from the smooth surface that is to be cleaned. In this manner, the dirty water is reliably suctioned off.

The water feed line could apply the water onto the smooth surface that is to be cleaned, so that merely a film of water is applied onto the smooth surface that is to be cleaned. A film of water optimizes the amount of water needed for cleaning purposes. The robot only has to carry along a minimal amount of water in order to clean a smooth surface. Furthermore, only a minimal amount of cleansing agent is needed in order to clean a smooth surface. By applying a film of water, a robot can be moved automatically on a window pane without being connected to a water reservoir via a hose connection. Therefore, the robot can also be used at very great heights. Its transport to or repositioning on other surfaces is also simplified.

The water feed line could supply at least 1 gram of water for each square meter of the smooth surface that is to be cleaned. Surprisingly, even with such a small amount, one square meter of a smooth surface—depending on its hydrophilic properties—can be covered with a film of water.

The water feed line could supply less than 2 grams of water for each square meter of the smooth surface that is to be cleaned. With this small amount of water, it has proven to be advantageous that especially floors made of wood can be reliably cleaned, without this causing the wood to swell.

The water feed line could supply at least 3 grams of water for each square meter of the smooth surface that is to be cleaned. This amount of water has proven to be practical in the case of relatively hydrophobic smooth surfaces.

The water feed line could supply 100 grams of water at the most for each square meter of the smooth surface that is to be cleaned. Surprisingly, it has been found that, depending on the smooth surface that is to be cleaned and/or on the traveling speed of the robot, a film of water can still be achieved, even with this amount of water, and without forming drops. Concretely, the advantage of applying small amounts of water is that no water rivulets are formed and no water drips onto the window sill.

The water feed line could supply between 2 grams and 15 grams of water for each square meter of the smooth surface that is to be cleaned. This amount of water is especially preferred for the levels of dirt normally encountered.

Especially preferably, the water feed line could supply between 3 grams and 10 grams of water for each square meter of the smooth surface that is to be cleaned. In most application cases, this relatively small amount of water is nevertheless sufficient to produce a film of water that covers the surface.

The water feed line could supply the water through a bundle of fibers, tubes and/or filaments to the smooth surface that is to be cleaned. Thanks to the capillary effect of the fibers, tubes and/or filaments of the bundle, the water can be applied surprisingly uniformly and quickly onto the smooth surface that is to be cleaned, without causing streaks and without forming drops.

Examples of bundles of the above-mentioned type are described in German patent applications DE 199 47 459 A1 or DE 196 11 371 A1. The bundles can be combined with sponges, fabrics and/or textiles.

Before this backdrop, a distribution layer could be arranged on the bundle for placement onto the smooth surface. The distribution layer draws the water out of the bundle and distributes it uniformly onto the smooth surface. The distribution layer can be configured as a non-woven, a textile, a woven fabric or a knit fabric.

Before this backdrop, the water drain line could drain the water through a bundle of fibers and/or filaments away from the smooth surface that is to be cleaned. The bundle uniformly absorbs the water that is to be drained.

A source of negative pressure in the water drain line can suction off the water that is to be drained, and water can be refilled via the water feed line by means of a source of pressure.

A stripper element could be arranged downstream from the water drain line. A stripper element, especially in the form of a scraping lip, preferably made of rubber, carries water to the water drain line. This ensures that virtually no residual water is left on the surface that is to be cleaned.

In another embodiment, the invention provides a method for cleaning smooth surfaces that is characterized in that the water is applied to the smooth surface by means of a capillary effect.

Negative pressure could be used to remove the water from the smooth surface that is to be cleaned. The water can be suctioned off by means of a source of negative pressure in this manner.

The water could be removed from the smooth surface by means of a capillary effect. The dirty water is reliably suctioned off in this manner.

The method and the above-mentioned robot can clean window panes. Advantageously, thanks to its light weight, the robot can be used at very great heights. Moreover, a long operating time, accompanied by a good cleaning performance, can be achieved.

The method could be used to clean floors, the smooth surfaces being in the form of floors. Thanks to the small amounts of water, especially wood floors do not swell.

There are various possibilities for configuring and refining the teaching of the present invention in an advantageous manner. Towards this end, reference is hereby made, on the one hand, to the subordinate claims, and, on the other hand, to the explanation below of a preferred embodiment of the robot according to the invention, making reference to the drawing.

FIG. 1 shows a robot for cleaning smooth surfaces, comprising a base 1, said base 1 having a traveling device 2 by means of which the base 1 can be moved on a smooth surface 3 that is to be cleaned, said base 1 having a cover 4 with which an area of the smooth surface 3 that is to be cleaned can be covered, and said base 1 having a water feed line 6 to apply water into a space 7 delimited by the cover 4 and the smooth surface 3, as well as a water drain line 8 to drain dirty water out of this space 7.

The water flow path is shown by the contoured arrows. The direction of movement is shown by the solid arrow.

The water is applied to the smooth surface 3 by means of a capillary effect and it is removed again by means of a capillary effect.

The water feed line 6 carries the water to the smooth surface 3 that is to be cleaned, in such a way that only a film of water 9 is applied onto the smooth surface 3 that is to be cleaned. This is shown schematically in FIG. 2. The water feed line 6 supplies between 3 grams and 10 grams of water for each square meter of the smooth surface 3 that is to be cleaned.

FIG. 1 shows that the water feed line 6 supplies the water through a bundle 10 of fibers, tubes and/or filaments 11 to the smooth surface 3 that is to be cleaned. The water is applied in the form of a film of water 9 onto the smooth surface 3. For purposes of distributing the water, a distribution layer 12 is arranged between the bundle 10 of the water feed line 6 and the smooth surface 3.

Figure 2:
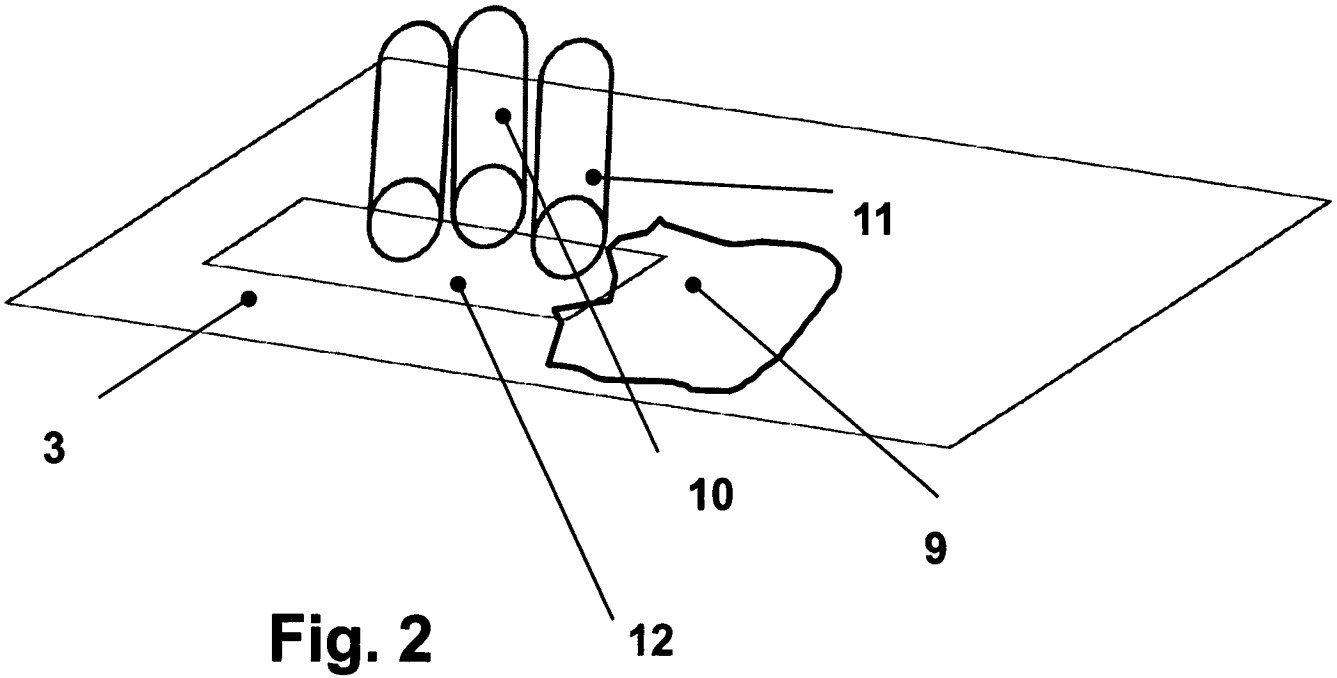
FIG. 2 is a schematic view of a bundle of fibers through which a film of water is applied onto the window pane.

FIG. 2 shows that water is fed through a bundle 10 of fibers, tubes and/or filaments 11 to the smooth surface 3 that is to be cleaned. Such a bundle 10 is associated with the water feed line 6 as shown in FIG. 1. The water is applied in the form of a film of water 9 onto the smooth surface 3. The water drain line 8 carries the water through an associated bundle of fibers, tubes and/or filaments 11 away from the smooth surface 3 that is to be cleaned. The smooth surfaces 3 are in the form of window panes.

FIG. 1 shows a robot for cleaning smooth surfaces 3, comprising a base 1, said base 1 having a traveling device 2 by means of which the base 1 can be automatically moved on a smooth surface 3 that is to be cleaned, and said base 1 having a water feed line 6 to apply water to the smooth surface 3 and a water drain line 8 to drain dirty water from the smooth surface 3. The water feed line 6 applies the water to the smooth surface by means of a capillary effect. The water drain line 8 removes the water by means of a capillary effect from the smooth surface 3 that is to be cleaned.

The water feed line 6 applies the water onto the smooth surface 3 that is to be cleaned, so that merely a film of water 9 is applied onto the smooth surface 3 that is to be cleaned. The water feed line 6 has a bundle 10 of fibers, tubes and/or filaments 11. A distribution layer 12 is arranged on the bundle 10 of the water feed line 6 for placement onto the smooth surface 3. The water drain line 8 has a bundle 10 of fibers, tubes and/or filaments 11.

A stripper element 13 is arranged downstream from the water drain line 8 in the direction of movement. The stripper element 13 is configured as a scraping lip made of rubber and conveys water to the water drain line 8. This ensures that virtually no residual water is left on the surface 3 that is to be cleaned.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the attached claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

The invention claimed is:

1. An automatic robot for cleaning smooth surfaces, comprising:

a base having a traveling device, a source of negative pressure, a water feed line and a water drain line, the traveling device being configured to automatically move the base on a smooth surface to be cleaned, the water feed line being configured to apply from 1 gram to 15 grams of water for each square meter of the smooth surface to the smooth surface using a capillary effect and the water drain line being configured to drain dirty water from the smooth surface, the water drain line being disposed so as to be adjacent the smooth surfaces and including a straight bundle of at least one of fibers, tubes and filaments configured to remove the water from the smooth surface using the capillary effect and having a negative pressure from the source of negative pressure such that the water removed by the capillary effect is immediately suctioned through the straight bundle.

2. The robot according to claim 1, wherein the water feed line is configured to apply only a film of the water onto the smooth surface.

3. The robot according to claim 1, wherein the water feed line is configured to supply less than 2 grams of the water for each square meter of the smooth surface.

4. The robot according to claim 1, wherein the water feed line is configured to supply between 3 grams and 10 grams of the water for each square meter of the smooth surface.

5. The robot according to claim 1, wherein the water feed line includes a bundle of at least one of fibers, tubes and filaments, and is configured to supply the water through the bundle to the smooth surface.

6. The robot according to claim 5, further comprising a distribution layer disposed on the bundle and configured to be placed onto the smooth surface.

7. The robot according to claim 1, further comprising a stripper element disposed downstream from the water drain line.

8. A method for cleaning smooth surfaces, comprising:

moving an automatic robot on a smooth surface to be cleaned;

applying, by the robot, from 1 gram to 15 grams of water for each square meter of the smooth surface onto the smooth surface using a capillary effect; and removing, by the robot, the water from the smooth surface using the capillary effect of a straight bundle of at least one of fibers, tubes and filaments of a water drain line disposed adjacent the smooth surfaces that has a negative pressure to immediately suction the water removed by the capillary effect through the bundle.

9. The method according to claim 8, wherein the smooth surface is a window pane.

10. The method according to claim 8, wherein the smooth surface is a floor.

* * * * *